US012304768B2

(12) United States Patent
Ando

(10) Patent No.: US 12,304,768 B2
(45) Date of Patent: May 20, 2025

(54) SHEET CONVEYANCE DEVICE AND IMAGE FORMING SYSTEM

(71) Applicant: KYOCERA Document Solutions Inc., Osaka (JP)

(72) Inventor: Yoshihiro Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 216 days.

(21) Appl. No.: 18/351,347

(22) Filed: Jul. 12, 2023

(65) Prior Publication Data

US 2024/0025678 A1 Jan. 25, 2024

(30) Foreign Application Priority Data

Jul. 21, 2022 (JP) ..... 2022-116240

(51) Int. Cl.

| | |
|---|---|
| ***B65H 7/14*** | (2006.01) |
| ***B65H 1/04*** | (2006.01) |
| ***B65H 1/14*** | (2006.01) |
| ***B65H 1/18*** | (2006.01) |

(52) U.S. Cl.

CPC ..... *B65H 7/14* (2013.01); *B65H 1/04* (2013.01); *B65H 1/14* (2013.01); *B65H 1/18* (2013.01); *B65H 2402/442* (2013.01); *B65H 2405/115* (2013.01); *B65H 2405/1412* (2013.01); *B65H 2405/15* (2013.01); *B65H 2407/10* (2013.01); *B65H 2511/417* (2013.01); *B65H 2553/412* (2013.01); *B65H 2553/61* (2013.01)

(58) Field of Classification Search

CPC ... B65H 1/04; B65H 1/14; B65H 1/18; B65H 7/02; B65H 7/04; B65H 7/14

See application file for complete search history.

(56) References Cited

U.S. PATENT DOCUMENTS

| | | | | |
|---|---|---|---|---|
| 4,763,891 | A * | 8/1988 | Kodama | B65H 1/14 271/157 |
| 2015/0338821 | A1 | 11/2015 | Fuchimoto | |
| 2017/0210583 | A1 * | 7/2017 | Masuda | B65H 1/14 |

FOREIGN PATENT DOCUMENTS

| | | | | |
|---|---|---|---|---|
| JP | 57160843 | A * | 10/1982 | B65H 7/04 |
| JP | 2015-220670 | A | 12/2015 | |

* cited by examiner

*Primary Examiner* — Prasad V Gokhale

(74) *Attorney, Agent, or Firm* — Stein IP, LLC

(57) ABSTRACT

A sheet conveyance device includes a cover member, a sheet stacking tray, a control portion, and an optical sensor. The cover member has a stationary rib that enters and retreats from an optical path along with opening and closing of the cover member, and a swingable rib that enters and retreats from the optical path along with up-down movement of the sheet on the sheet stacking tray. The control portion, based on an amount of received light incident on the optical sensor, detects an opened state and a closed state of the cover member and an up-down position of the sheet stacked on the sheet stacking tray.

5 Claims, 3 Drawing Sheets

SHEET CONVEYANCE DEVICE AND IMAGE FORMING SYSTEM

INCORPORATION BY REFERENCE

This application is based on and claims the benefit of priority from Japanese Patent Application No. 2022-116240 filed on Jul. 21, 2022, the contents of which are hereby incorporated by reference.

BACKGROUND

The present disclosure relates to a sheet conveyance device and an image forming system.

A sheet conveyance device that conveys a sheet may include an opening portion for supplying a sheet therethrough into a device main body thereof and a cover member for the opening portion. Moreover, for safe and appropriate sheet conveyance, the sheet conveyance device may perform detection of opening and closing of the cover member and detection of the position of a sheet.

SUMMARY

According to an aspect of the present disclosure, a sheet conveyance device includes a device main body, a cover member, a sheet stacking tray, an ascent-descent drive portion, a sheet conveyance portion, and a control portion. The device main body has an opening portion in an upper surface thereof. The cover member is supported on the device main body so as to be openable and closable with respect to the opening portion. The sheet stacking tray is supported inside the device main body so as to be capable of ascending and descending, and a sheet is stacked thereon. The ascent-descent drive portion causes the sheet stacking tray to ascend and descend. The sheet conveyance portion, at a predetermined conveyance position in an up-down direction, contacts the sheet stacked on the sheet stacking tray, and conveys the sheet downstream in a sheet conveyance direction. The control portion controls operations of the ascent-descent drive portion and the sheet conveyance portion. The device main body has an optical sensor including a light emitting portion and a light receiving portion that are disposed, to be opposed to each other, at opposite end parts of the device main body in a sheet width direction orthogonal to the sheet conveyance direction of the sheet stacked on the sheet stacking tray. The cover member has a stationary rib, a swingable rib, a first hole portion, and a second hole portion. The stationary rib protrudes toward an inside of the device main body, and enters and retreats from an optical path of the optical sensor along with opening and closing of the cover member with respect to the opening portion. The swingable rib is attached to the cover member so as to be swingable in an up-down direction toward the inside of the device main body, contacts the sheet stacked on the sheet stacking tray, and enters and retreats from the optical path of the optical sensor along with up-down movement of the sheet caused by ascent and descent of the sheet stacking tray. The first hole portion is provided in the stationary rib, and, in a case where the cover member is in a closed state, the first hole portion is disposed in the optical path of the optical sensor such that light from the optical sensor passes through the first hole portion. The second hole portion is provided in the swingable rib, and, in a case where the cover member is in a closed state and the sheet stacked on the sheet stacking tray is located at the conveyance position, the second hole portion is disposed in the optical path of the optical sensor such that light from the optical sensor passes through the second hole portion. The control portion, based on an amount of received light incident on the light receiving portion, detects the opened state and the closed state of the cover member and an up-down position of the sheet stacked on the sheet stacking tray.

DETAILED DESCRIPTION

An embodiment of the present disclosure will be described below with reference to the accompanying drawings.

The present disclosure, however, is not limited to what is specifically described below.

Figure 1:
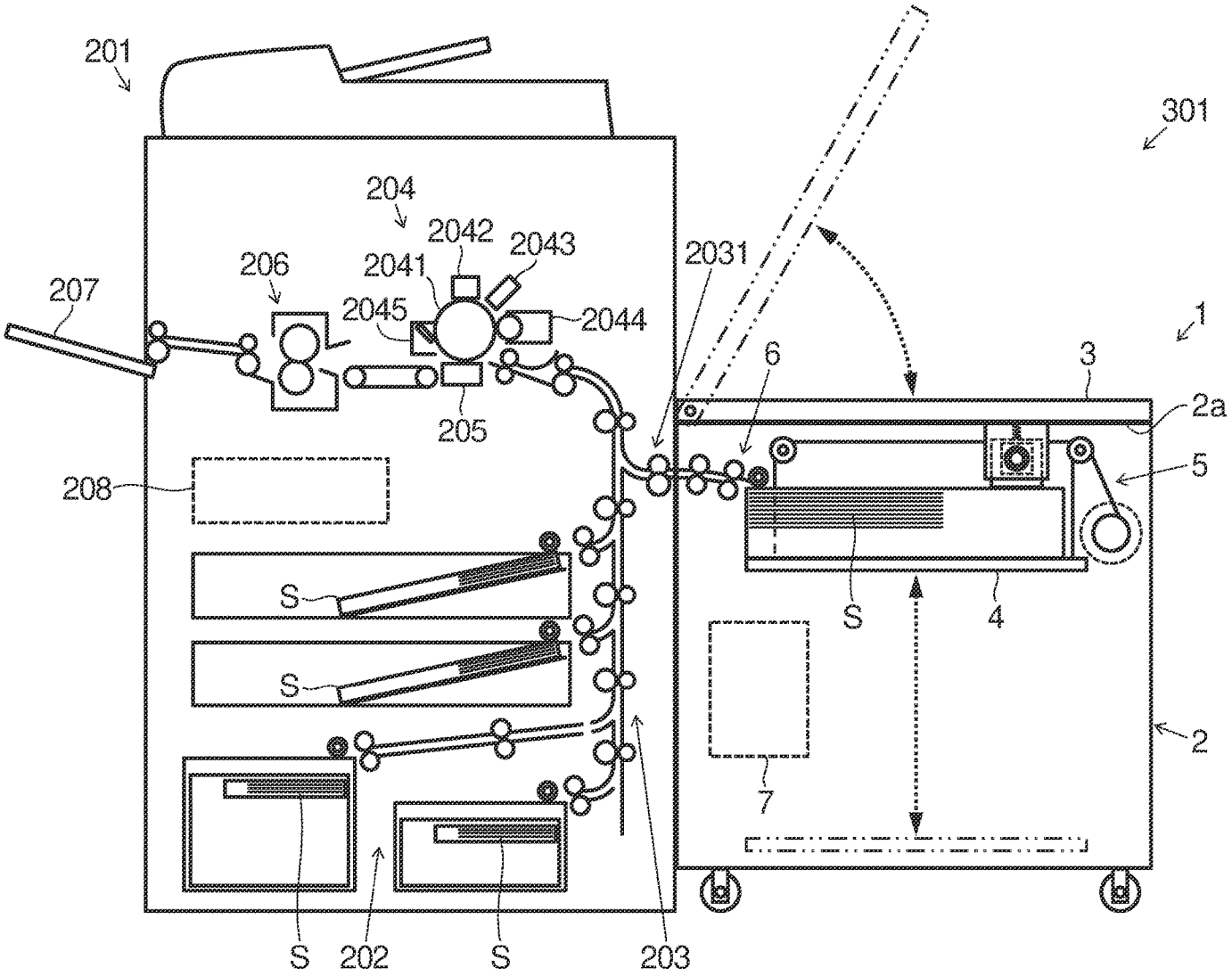
FIG. 1 is a schematic sectional front view of an image forming system according to an embodiment of the present disclosure.

FIG. 1 is a schematic sectional front view of an image forming system 301 according to an embodiment of the present disclosure. The image forming system 301 includes, as shown in FIG. 1, an image forming apparatus 201 and a sheet conveyance device 1.

The image forming apparatus 201 is, for example, what is called a monochrome-capable multifunction peripheral equipped with functions of printing, scanning (image reading), facsimile transmission and reception, etc. The image forming apparatus 201 may instead be an apparatus such as a copier, a printer, or the like, or may be color-capable instead of monochrome-capable.

The image forming apparatus 201 includes, as shown in FIG. 1, a sheet storing portion 202, a sheet feeding portion 203, an image forming portion 204, a transfer portion 205, a fixing portion 206, a sheet discharge portion 207, and an image formation control portion 208.

The sheet storing portion 202 is disposed in a bottom part of the image forming apparatus 201. The sheet storing portion 202 stores therein a plurality of sheets S that are unprinted, and feeds the sheets S out separately one by one during printing.

The sheet feeding portion 203 extends in an up-down direction along a side wall of the image forming apparatus 201. The sheet feeding portion 203 conveys a sheet S having been fed out from the sheet storing portion 202 to the transfer portion 205 and then to the fixing portion 206, and further discharges the sheet S having undergone fixing to the sheet discharge portion 207. The sheet feeding portion 203 has a confluence portion 2031. The confluence portion 2031 opens in a side surface of the image forming apparatus 201, and a sheet conveyance path of the sheet conveyance device 1 meets the confluence portion 2031. The image forming apparatus 201, via the confluence portion 2031, accepts a sheet S having been fed out from the sheet conveyance device 1.

The image forming portion 204 is disposed above the transfer portion 205. The image forming portion 204 includes a photosensitive drum 2041 that is supported to be rotatable in a predetermined direction. The image forming portion 204 further includes a charging portion 2042, an exposure portion 2043, a developing portion 2044, and a cleaning portion 2045 that are arranged around the photosensitive drum 2041 along a rotation direction thereof.

In the image forming portion 204, a surface of the photosensitive drum 2041 is charged to a predetermined potential by the charging portion 2042, and an electrostatic latent image of an original image is formed on the surface of the photosensitive drum 2041 by laser light irradiated from the exposure portion 2043. The developing portion 2044 supplies toner to the electrostatic latent image to develop it, and thereby forms a toner image. The cleaning portion 2045 performs cleaning by removing toner and the like remaining on the surface of the photosensitive drum 2041 after the toner image is transferred onto the sheet S. In this manner, the image forming portion 204 forms an image (a toner image) to be transferred to a sheet S at the transfer portion 205.

The transfer portion 205 transfers the toner image formed on the surface of the photosensitive drum 2041 to the sheet S. The fixing portion 206 is disposed downstream of the transfer portion 205 with respect to a sheet conveyance direction. The fixing portion 206 applies heat and pressure to the sheet S having the toner image transferred thereon, and thereby fixes the toner image on the sheet S.

The sheet discharge portion 207 is disposed on a side surface of the image forming apparatus 201 opposite to a side surface of the image forming apparatus 201 to which the sheet feeding portion 203 is adjacent. The sheet S having the toner image fixed thereon is conveyed to be discharged onto the sheet discharge portion 207. The sheet discharge portion 207 is configured such that a printed sheet (printed matter) can be taken out of it from above.

The image formation control portion 208 includes a CPU, an image processor, a storage, and other electronic circuits and parts (of which none is illustrated). The CPU controls operations of various components provided in the image forming apparatus 201 based on a control program and control data stored in the storage, and thereby performs processing related to functions of the image forming apparatus 201. The sheet storing portion 202, the sheet feeding portion 203, the image forming portion 204, the transfer portion 205, and the fixing portion 206 each individually receive instructions from the image formation control portion 208, and cooperate with each other to perform printing on a sheet S. The storage is constituted of, for example, a combination of nonvolatile storage devices such as a program ROM (read only memory), a data ROM, etc., and a volatile storage device such as a RAM (random access memory), of which none is illustrated.

With the above configuration, the image forming apparatus 201 forms an image on a sheet S.

The sheet conveyance device 1 is disposed outside the image forming apparatus 201, adjacent to the image forming apparatus 201. The sheet conveyance device 1 is coupled to a side surface of the image forming apparatus 201 in an attachable-detachable manner. Note that the sheet conveyance device 1 can be coupled to an apparatus such as a copier, a printer, or the like, as well as a multifunction peripheral. The sheet conveyance device 1 stores a plurality of sheets S that are to be subjected to image formation (printing) in the image forming apparatus 201, and feeds them out to the image forming apparatus 201 separately one by one.

Figure 2:
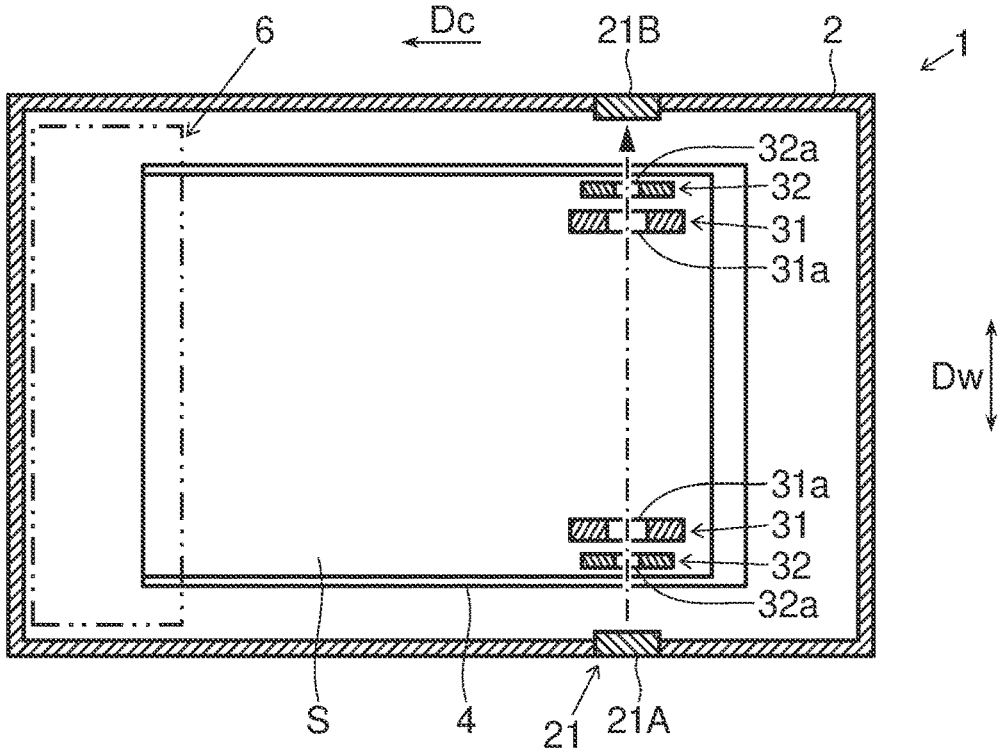
FIG. 2 is a sectional top view of a sheet conveyance device shown in FIG. 1.
Figure 3:
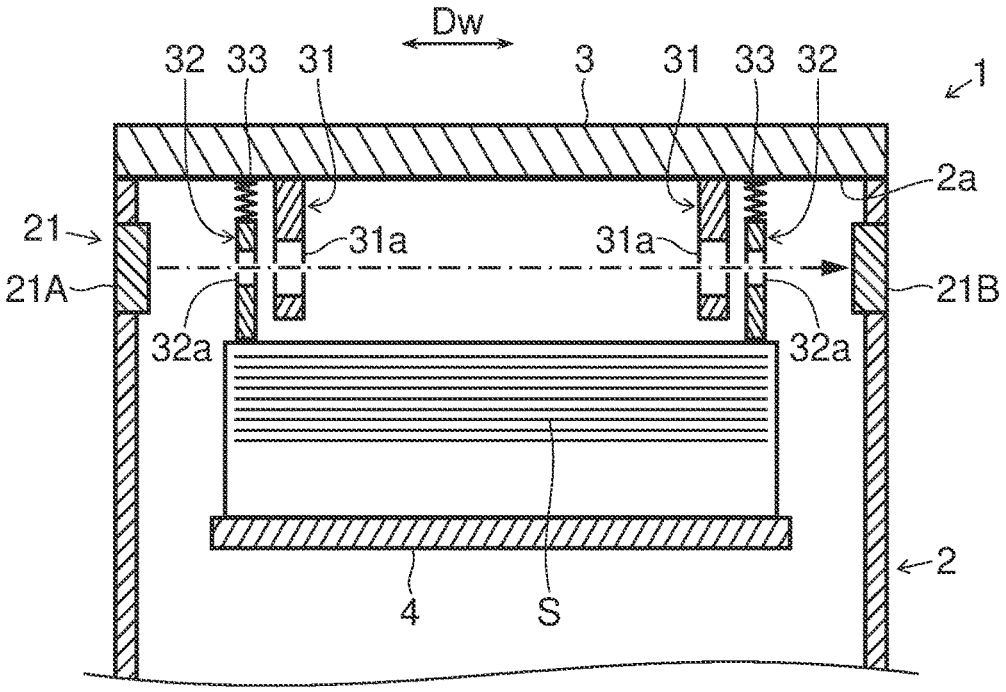
FIG. 3 is a sectional side view of the sheet conveyance device shown in FIG. 1.
Figure 4:
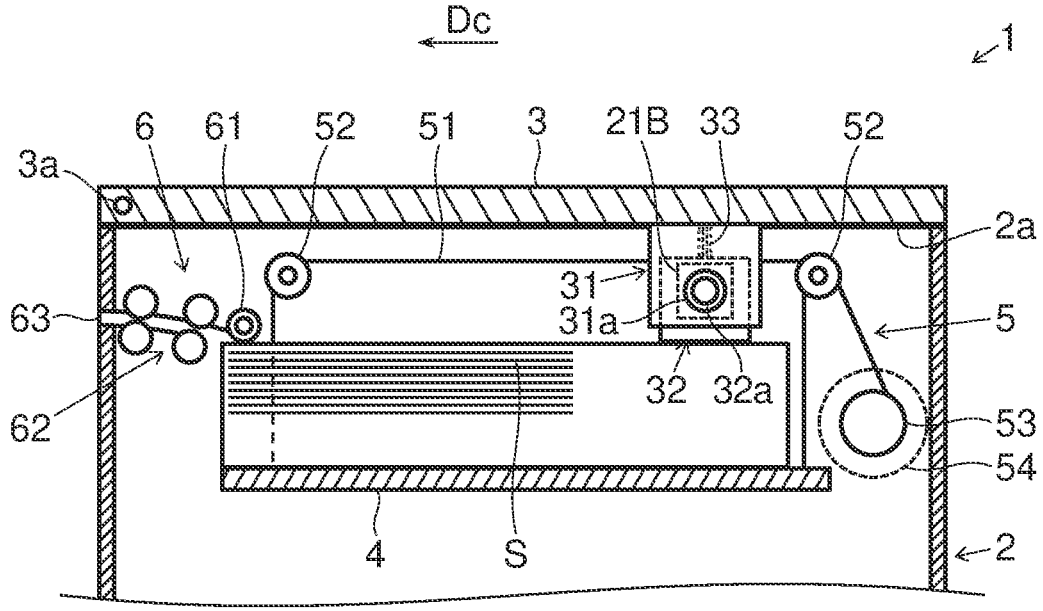
FIG. 4 is a sectional front view of the sheet conveyance device shown in FIG. 1 (with a cover member in a closed state).

Next, a configuration of the sheet conveyance device 1 will be described. FIG. 2, FIG. 3, and FIG. 4 are respectively a sectional front view, a sectional side view, and a sectional front view of the sheet conveyance device 1 shown in FIG. 1. In any of these figures, a cover member is in a closed state. Further, in FIG. 2 and FIG. 3, depiction of an ascent-descent drive portion 5 is omitted.

Note that, in the following description related to the sheet conveyance device 1, a direction from right to left in FIG. 2 and FIG. 4 is referred to as "the sheet conveyance direction" and indicated by an arrow Dc in FIG. 2 and figures following FIG. 2. Further, a "sheet width direction" orthogonal to the sheet conveyance direction is an up-down direction in FIG. 2 and a left-right lateral direction in FIG. 3, and is indicated by an arrow Dw in FIG. 2 and the figures following FIG. 2.

The sheet conveyance device 1 includes, as shown in FIGS. 1 to 4, a device main body 2, a cover member 3, a sheet stacking tray 4, an ascent-descent drive portion 5, a sheet conveyance portion 6, and a conveyance control portion (a control portion) 7.

The device main body 2 is formed substantially in a rectangular parallelepiped shape having therein a sheet storage space that accommodates on the order of several thousand sheets S. The device main body 2 includes the sheet stacking tray 4, the ascent-descent drive portion 5, and the sheet conveyance portion 6 in an inside thereof. The device main body 2 has an opening portion 2*a* in an upper surface thereof. The opening portion 2*a* is a supply port for supplying a sheet S to the sheet conveyance device 1.

The cover member 3 is formed substantially in a flat plate shape, and is disposed at the opening portion 2*a* of the device main body 2. The cover member 3 is supported on the device main body 2 via a rotation shaft 3*a* that is provided at a downstream end part of the device main body 2 in the sheet conveyance direction Dc and that extends in the sheet width direction Dw. The cover member 3 is swingable about an axis of the rotation shaft 3*a* to be opened and closed with respect to the opening portion 2*a* of the device main body 2.

The sheet stacking tray 4, which is formed substantially in a shape of a flat plate that is substantially rectangular and that extends horizontally, is disposed inside the device main body 2. The sheet stacking tray 4 is attached to a guide member (not shown) that extends in an up-down direction, and is movable in the up-down direction. In other words, the sheet stacking tray 4 is supported inside the device main body 2 so as to be capable of ascending and descending. On an upper surface of the sheet stacking tray 4, a sheet S is stacked.

The ascent-descent drive portion 5 is disposed inside the device main body 2. The ascent-descent drive portion 5 includes a plurality of wires 51, a plurality of relay pulleys 52, a plurality of wind-up pulleys 53, and a drive source 54.

The ascent-descent drive portion 5 in the present embodiment has, for example, four wires 51. The four wires 51 are disposed two on each of opposite-end-part sides of the sheet stacking tray 4 in the sheet width direction Dw. One end of each of the four wires 51 is connected to the sheet stacking tray 4 at one of four positions that are on upstream and downstream parts thereof in the sheet conveyance direction Dc, and that are in opposite end parts in the sheet width direction Dw, that is, one end of each of the four wires 51 is connected to a position in the vicinity of one of four corners of the sheet stacking tray 4, which substantially has a rectangular shape. The other end of each of the four wires 51 is connected to one of the wind-up pulleys 53.

The relay pulleys 52 are respectively disposed above the sheet stacking tray 4, on opposite-end-part sides of the sheet stacking tray 4 in the sheet width direction Dw. Specifically, the relay pulleys 52, four in number, are disposed above positions at which the four wires 51 are connected to the sheet stacking tray 4. Around the relay pulleys 52, the wires 51 are wound.

The wind-up pulleys 53 are disposed one on each of opposite-end-part sides of the sheet stacking tray 4 in the sheet width direction Dw. The wind-up pulleys 53 are connected to the drive source 54 that is constituted of a motor, for example. The wind-up pulleys 53 are caused to rotate forward and backward by rotation driving force of the drive source 54.

In the ascent-descent drive portion 5, when the drive source 54 causes the wind-up pulleys 53 to rotate forward, the wires 51 are wound up around outer circumferential surfaces of the wind-up pulleys 53, and this causes the sheet stacking tray 4 to ascend. On the other hand, in the ascent-descent drive portion 5, when the drive source 54 causes the wind-up pulleys 53 to rotate backward, the wires 51 are wound off from the wind-up pulleys 53, and this causes the sheet stacking tray 4 to descend. In this manner, the ascent-descent drive portion 5 causes the sheet stacking tray 4 to ascend and descend. The ascent-descent drive portion 5 has its operation controlled by the conveyance control portion 7.

The sheet conveyance portion 6 is disposed in an upper part of the device main body 2. The sheet conveyance portion 6 includes a pickup roller 61, a pair of conveyance rollers 62, and a sheet discharge port 63.

The pickup roller 61 is disposed above a downstream part of the sheet stacking tray 4 in the sheet conveyance direction Dc. The pickup roller 61 is disposed so as to be opposed to the sheet stacking tray 4 in the up-down direction. The pickup roller 61, at a predetermined conveyance position in the up-down direction, contacts a sheet S stacked on the sheet stacking tray 4. The pair of conveyance rollers 62 are disposed downstream of the pickup roller 61 with respect to the sheet conveyance direction Dc.

In a state where a sheet S stacked on the sheet stacking tray 4 is located at the predetermined conveyance position, when the pickup roller 61 rotates, the sheet S is fed out downstream in the sheet conveyance direction Dc. In the sheet conveyance portion 6, the sheet S that the pickup roller 61 has fed out from the sheet stacking tray 4 is then conveyed by the pair of conveyance rollers 62 further downstream in the sheet conveyance direction Dc. In this manner, the sheet conveyance portion 6, at the predetermined conveyance position, contacts a sheet S stacked on the sheet stacking tray 4, and conveys the sheet S downstream in the sheet conveyance direction Dc.

The sheet discharge port 63 is opened in a side surface of the sheet conveyance device 1, and is connected to the confluence portion 2031 of the image forming apparatus 201. The sheet conveyance device 1 conveys a sheet S via the sheet discharge port 63 of the sheet conveyance portion 6 toward the image forming apparatus 201. The sheet conveyance portion 6 has its operation controlled by the conveyance control portion 7.

The conveyance control portion 7 includes a CPU, an image processor, a storage, and other electronic circuits and parts (of which none is illustrated). The conveyance control portion 7 is communicably connected to the image formation control portion 208 of the image forming apparatus 201. The conveyance control portion 7 receives instructions from the image formation control portion 208, and by means of the CPU and based on a control program and control data stored in the storage, controls operations of various components provided in the sheet conveyance device 1, to thereby perform processing related to functions of the sheet conveyance device 1. The ascent-descent drive portion 5 and the sheet conveyance portion 6 each individually receive instructions from the conveyance control portion 7, and cooperate with each other to perform conveyance of a sheet S. Note that the function of the conveyance control portion (the control portion) 7 may be given to the image formation control portion 208 of the image forming apparatus 201 instead.

Figure 5:
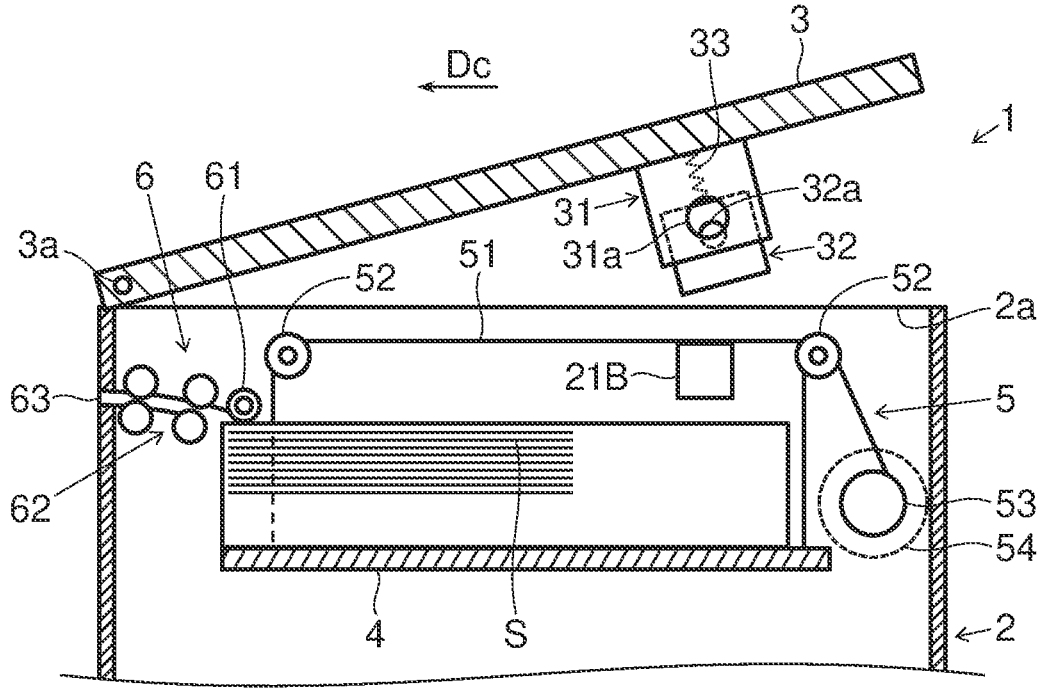
FIG. 5 is a sectional front view of the sheet conveyance device shown in FIG. 1 (with the cover member an opened state).

Next, a description will be given of a detailed configuration of the sheet conveyance device 1. FIG. 5 is a sectional front view of the sheet conveyance device 1 shown in FIG. 1 (with the cover member in an opened state).

The device main body 2, as shown in FIGS. 2 to 5, has an optical sensor 21. The optical sensor 21 is disposed, in the upper part of the device main body 2, at an upstream part thereof in the sheet conveyance direction Dc, for example. The optical sensor 21 is located, in the up-down direction, above a topmost surface of a sheet S stacked on the sheet stacking tray 4 when the topmost surface is located at the predetermined conveyance position.

The optical sensor 21 is a transmissive sensor, and includes a light emitting portion 21A and a light receiving portion 21B. The light emitting portion 21A and the light receiving portion 21B are disposed at opposite end parts of the device main body 2 in the sheet width direction Dw so as to be opposed to each other. Light emitted from the light emission portion 21A is incident on the light reception portion 21B. That is, from the light emitting portion 21A toward the light receiving portion 21B, an optical path (indicated by dashed-dotted line arrows in FIGS. 2 and 3) of the optical sensor 21 extends in the sheet width direction Dw. The optical sensor 21 outputs a light detection signal that varies depending on an amount of received light incident on the light receiving portion 21B. The conveyance control portion 7 receives the detection signal from the optical sensor 21.

The cover member 3 has a stationary rib 31 and a swingable rib 32. The stationary rib 31 and the swingable rib 32 are each attached to a lower surface of the cover member 3. The stationary rib 31 and the swingable rib 32 are each located above the topmost surface of a sheet S stacked on the sheet stacking tray 4 when the topmost surface is located at the predetermined conveyance position, so as to be opposed to the sheet S in the up-down direction.

The stationary rib 31 and the swingable rib 32 are each provided in a pair on the cover member 3. Two stationary ribs 31 included in the pair of stationary ribs 31 are disposed on the cover member 3 so as to be opposed to each other in the sheet width direction Dw. Two swingable ribs 32 included in the pair of swingable ribs 32 are disposed on the cover member 3 so as to be opposed to each other in the sheet width direction Dw. The stationary ribs 31 and the swingable ribs 32 are respectively disposed one at each of opposite end parts of the cover member 3 in the sheet width direction Dw.

The stationary ribs 31 protrude toward an inside of the device main body 2. The stationary ribs 31 each have an upper end part thereof fixed to the lower surface of the cover member 3. The stationary ribs 31 are members having a flat plate shape extending along the up-down direction and the sheet conveyance direction Dc.

The stationary ribs 31 are located so as to intersect the optical path of the optical sensor 21 when the cover member 3 is in the closed state. The stationary ribs 31, along with opening and closing of the cover member 3 with respect to the opening portion 2*a* of the device main body 2, enters and retreats from the optical path of the optical sensor 21. The stationary ribs 31 have first hole portions 31*a*.

The first hole portions 31*a* are each formed to be circular as seen from the sheet width direction Dw, and penetrate the stationary ribs 31 in the sheet width direction Dw. The first hole portions 31*a* are disposed at such positions in the stationary ribs 31 as intersect the optical path of the optical sensor 21 when the cover member 3 is in the closed state. That is, the first hole portions 31*a* are located in the optical path of the optical sensor 21 when the cover member 3 is in the closed state such that the light from the optical sensor 21 passes through the first hole portions 31*a*.

The swingable ribs 32 are each attached via an elastic member 33 to the lower surface of the cover member 3. The elastic member 33 is constituted of a spring, for example, that is stretchable and compressible in the up-down direction. Thereby, the swingable ribs 32 are attached to the cover member 3 so as to be swingable in the up-down direction toward the inside of the device main body 2. The swingable ribs 32 are members having a flat plate shape extending along the up-down direction and the sheet conveyance direction Dc.

The swingable ribs 32 are located so as to intersect the optical path of the optical sensor 21 when the cover member 3 is in the closed state. Further, lower ends of the swingable ribs 32, when the cover member 3 is in the closed state, contact a sheet S stacked on the sheet stacking tray 4. Note that, when the cover member 3 is in the closed state and a sheet S stacked on the sheet stacking tray 4 is located at a non-conveyance position which is below the predetermined conveyance position, the lower ends of the swingable ribs 32 are caused by elasticity of the elastic member 33 to be located at positions lower than the topmost surface of the sheet S located at the conveyance position. That is, the swingable ribs 32, along with up-down movement of the sheet S caused by ascent and descent of the sheet stacking tray 4, enters and retreats from the optical path of the optical sensor 21. The swingable ribs 32 have second hole portions 32*a*.

The second hole portions 32*a* are each formed to be circular as seen from the sheet width direction Dw, and penetrate the swingable ribs 32 in the sheet width direction Dw. The second hole portions 32*a* are located in the swingable ribs 32 so as to intersect the optical path of the optical sensor 21 when the cover member 3 is in the closed state. That is, when the cover member 3 is in the closed state and a sheet S stacked on the sheet stacking tray 4 is located at the predetermined conveyance position, the second hole portions 32*a* are located in the optical path of the optical sensor 21 such that the light from the optical sensor 21 passes through the second hole portions 32*a*.

The amount of received light incident on the light receiving portion 21B of the optical sensor 21 varies between light emitted from the light emitting portion 21A and outside light other than the light emitted from the light emitting portion 21A. In this relation, both in a case where, as shown in FIG. 4, for example, the cover member 3 is in the closed state and a sheet S stacked on the sheet stacking tray 4 is located at the predetermined conveyance position and in a case where the cover member 3 is in the opened state as shown in FIG. 5, the light emitted from the light emitting portion 21A is incident on the light receiving portion 21B without being intercepted. That is, the amount of sensor light incident on the light receiving portion 21B is basically equal and unlikely to differ in these cases. However, between a case where the cover member 3 is in the closed state and a case where the cover member 3 is in the opened state, the amount of outside light incident on the light receiving portion 21B differs, and the difference can be detected.

Thereby, based on the amount of received light incident on the light receiving portion 21B of the optical sensor 21, the conveyance control portion 7 detects the opened state and the closed state of the cover member 3 and an up-down position of a sheet S stacked on the sheet stacking tray 4. According to this configuration, using the single optical sensor 21, it is possible to detect the opened state and the closed state of the cover member 3 and the up-down position of the sheet S stacked on the sheet stacking tray 4. Accordingly, it is possible to achieve cost reduction of the sheet conveyance device 1.

Here, in the present embodiment, the second hole portions 32*a* of the swingable ribs 32 have an inner diameter that is larger than an inner diameter of the first hole portions 31*a* of the stationary ribs 31. This configuration, in which consideration is given to structure tolerance and the like, facilitates detection of opening and closing of the cover member 3. This configuration further facilitates detection of a minute difference in the up-down position of a sheet S. Note that, the size relationship between the first hole portion 31*a* and the second hole portions 32*a*, the inner diameters thereof, etc. can be suitably set as necessary depending on easiness of recognition of the opened state and the closed state of the cover member 3 and the up-down position of a sheet S.

The conveyance control portion 7 has a plurality of threshold values related to the amount of received light on the light receiving portion 21B of the optical sensor 21. In the present embodiment, the conveyance control portion 7 has, for example, three threshold values Th1, Th2, and Th3 related to the amount of received light on the light receiving portion 21B. The threshold values Th1, Th2, and Th3 are set regarding an output level Ls of the optical sensor 21, the output level Ls being based on the amount of received light on the light receiving portion 21B, and are stored in the storage or the like. Table 1 shows a relationship of the opened state and the closed state of the cover member 3 and the up-down position of the sheet stacking tray 4 with respect to the output level Ls of the optical sensor 21.

TABLE 1

| State | Optical Sensor Output Level Ls |
|---|---|
| Cover Member Opened | Th1 ≤ Ls |
| Cover Member Closed/Sheet at Conveyance Position | Th2 ≤ Ls < Th1 |
| Cover Member Deviated/Sheet at Non-Conveyance Position | Th3 ≤ Ls < Th2 |
| Cover Member Closed/Sheet at Non-Conveyance Position | Ls < Th3 |

The threshold values have a magnitude relationship of Th3<Th2<Th1. When the cover member 3 is in the opened state, a large amount of outside light is incident on the light receiving portion 21B of the optical sensor 21 through the opening portion 2*a* of the device main body 2, and thus the output level Ls of the optical sensor 21 becomes high. Thus, when the output level Ls of the optical sensor 21 is equal to or higher than the threshold value Th1, the conveyance control portion 7 detects that the cover member 3 is in the opened state.

When the cover member 3 is in the closed state and a sheet S stacked on the sheet stacking tray 4 is located at the predetermined conveyance position, the cover member 3 intercepts the outside light, but, on the optical path of the optical sensor 21, the first hole portions 31*a* of the stationary ribs 31 and the second hole portions 32*a* of the swingable ribs 32 overlap each other. As a result, the output level Ls of the optical sensor 21 is lower than the threshold value Th1, but it is mainly the sensor light from the light emitting portion 21A that is incident on the light receiving portion 21B of the optical sensor 21. Thus, when the output level Ls of the optical sensor 21 is equal to or higher than the threshold value Th2 but is lower than the threshold value Th1, the conveyance control portion 7 detects that the cover member 3 is in the closed state and that the sheet S stacked on the sheet stacking tray 4 is located at the predetermined conveyance position.

When the cover member 3 has deviated from the closed state, and a sheet S stacked on the sheet stacking tray 4 is located at the non-conveyance position which is not the predetermined conveyance position, the stationary ribs 31 and the swingable ribs 32 intercept the optical path of the optical sensor 21, but a small amount of outside light enters the device main body 2 through a gap between the device main body 2 and the cover member 3. As a result, the output level Ls of the optical sensor 21 becomes lower than the threshold value Th2, but the light receiving portion 21B of the optical sensor 21 receives a small amount of outside light. Thus, when the output level Ls of the optical sensor 21 is equal to or higher than the threshold value Th3 but is lower than the threshold value Th2, the conveyance control portion 7 detects that the cover member 3 has deviated from the closed state and that the sheet S stacked on the sheet stacking tray 4 is located at the non-conveyance position.

When the cover member 3 is in the closed state and a sheet S stacked on the sheet stacking tray 4 is located at the non-conveyance position, the cover member 3 intercepts the outside light and the swingable ribs 32 intercept the optical path of the optical sensor 21. As a result, the output level Ls of the optical sensor 21 becomes the lowest. Thus, when the output level Ls of the optical sensor 21 is lower than the threshold value Th3, the conveyance control portion 7 detects that the cover member 3 is in the closed state and that the sheet S stacked on the sheet stacking tray 4 is located at the non-conveyance position.

As has been discussed above, between the opened state and the closed state of the cover member 3, and between the conveyance position and the non-conveyance position of a sheet S stacked on the sheet stacking tray 4, the amount of received light on the light receiving portion 21B differs. Thus, the conveyance control portion 7 uses the plurality of threshold values to individually recognize the opened state and the closed state of the cover member 3 and the conveyance position and the non-conveyance position of a sheet S stacked on the sheet stacking tray 4.

Note that, although, in the above configuration, the opened state and the closed state of the cover member 3 and the up-down position of a sheet S are recognized based on an absolute value of the output level Ls of the optical sensor 21, they may instead be recognized based on an amount of change in the output level Ls.

With the above configuration, it is possible to suitably recognize and detect the opened state and the closed state of the cover member 3 and the up-down position of a sheet S stacked on the sheet stacking tray 4. Accordingly, in the sheet conveyance device 1 of which cost reduction has been achieved, it is possible to rapidly grasp a problem related to the cover member 3 and a sheet S.

Further, the stationary ribs 31 and the swingable ribs 32 are respectively provided in a pair to be disposed one at each of the opposite end parts in the sheet width direction Dw. With this configuration, regarding the sheet width direction Dw, for example, warp of the cover member 3, curl or bend of a sheet S, etc. can be recognized by means of the single optical sensor 21. Accordingly, in the sheet conveyance device 1 of which cost reduction has been achieved, it is possible to rapidly grasp a problem related to the cover member 3 and a sheet S.

Further, the swingable ribs 32 are each attached to the cover member 3 via the elastic member 33 which is stretchable and compressible in the up-down direction. With this configuration, it is possible, by means of the cover member 3, to appropriately recognize the up-down position of a sheet S stacked on the sheet stacking tray 4.

Further, with the above configuration, in the image forming system 301, which includes the sheet conveyance device 1 configured as described above and the image forming apparatus 201, it is possible, by means of the single optical sensor 21, to detect the opened state and the closed state of the cover member 3 and the up-down position of a sheet S stacked on the sheet stacking tray 4. Accordingly, it is possible to achieve lower cost of the image forming system 301.

The above-described embodiment is by no means meant to limit the scope of the present disclosure, and various modifications can be made and implemented within the scope not departing from the gist of the present disclosure.

For example, in the above embodiment, the image forming apparatus 201 included in the image forming system 301 is described as an image forming apparatus for monochrome printing, but the image forming apparatus 201 is not limited to an image forming apparatus of such a type. The image forming apparatus may instead be an image forming apparatus for color printing, for example.

What is claimed is:

1. A sheet conveyance device, comprising:

a device main body that has an opening portion in an upper surface thereof;

a cover member that is supported on the device main body so as to be openable and closable with respect to the opening portion;

a sheet stacking tray that is supported inside the device main body so as to be capable of ascending and descending, and on which a sheet is stacked;

an ascent-descent drive portion that causes the sheet stacking tray to ascend and descend;

a sheet conveyance portion that, at a predetermined conveyance position in an up-down direction, contacts the sheet stacked on the sheet stacking tray, and that conveys the sheet downstream in a sheet conveyance direction; and a control portion that controls operations of the ascent-descent drive portion and the sheet conveyance portion, wherein the device main body has an optical sensor including a light emitting portion and a light receiving portion that are disposed, so as to be opposed to each other, at opposite end parts of the device main body in a sheet width direction orthogonal to the sheet conveyance direction of the sheet stacked on the sheet stacking tray, the cover member has a stationary rib that protrudes toward an inside of the device main body, and that enters and retracts from an optical path of the optical sensor along with opening and closing of the cover member with respect to the opening portion, a swingable rib that is attached to the cover member so as to be swingable in an up-down direction toward the inside of the device main body, that contacts the sheet stacked on the sheet stacking tray, and that enters and retreats from the optical path of the optical sensor along with up-down movement of the sheet caused by ascent and descent of the sheet stacking tray, a first hole portion that is provided in the stationary rib, and that is disposed in the optical path of the optical sensor in a case where the cover member is in a closed state such that light from the optical sensor passes through the first hole portion, and a second hole that is provided in the swingable rib, and that is disposed in the optical path of the optical sensor in a case where the cover member is in a closed state and the sheet stacked on the sheet stacking tray is located at the conveyance position such that light from the optical sensor passes through the second hole portion, and the control portion, based on an amount of received light incident on the light receiving portion, detects the opened state and the closed state of the cover member and an up-down position of the sheet stacked on the sheet stacking tray.

2. The sheet conveyance device according to claim 1, wherein the control portion has a plurality of threshold values related to the amount of received light on the light receiving portion, and uses the plurality of threshold values to individually recognize each of the opened state and the closed state of the cover member and each of the conveyance position and a non-conveyance position of the sheet stacked on the sheet stacking tray.

3. The sheet conveyance device according to claim 1, wherein the stationary rib is provided in a pair on the cover member, and two of the stationary ribs included in the pair of the stationary ribs are disposed one at each of opposite end parts of the cover member in the sheet width direction, and the swingable rib is provided in a pair on the cover member, and two of the swingable ribs included in the pair of the swingable ribs are disposed one at each of the opposite end parts of the cover member in the sheet width direction.

4. The sheet conveyance device according to claim 1, wherein the swingable rib is attached to the cover member via an elastic member that is stretchable and compressible in the up-down direction.

5. An image forming system, comprising:

the sheet conveyance device according to claim 1; and an image forming apparatus that is coupled to the sheet conveyance device, and that forms an image on the sheet conveyed from the sheet conveyance device.

* * * * *